US011085005B2

(12) United States Patent
Martin et al.

(10) Patent No.: US 11,085,005 B2
(45) **Date of Patent: *Aug. 10, 2021**

(54) USE OF A FATTY AMINE FOR REDUCING AND/OR CONTROLLING THE ABNORMAL COMBUSTION OF GAS IN A MARINE ENGINE

(71) Applicant: TOTAL MARKETING SERVICES, Puteaux (FR)

(72) Inventors: Jean-Baptiste Martin, Luzinay (FR); Valérie Doyen, Four (FR)

(73) Assignee: TOTAL MARKETING SERVICES, Puteaux (FR)

( * ) Notice: Subject to any disclaimer, the term of this patent is extended or adjusted under 35 U.S.C. 154(b) by 22 days.

This patent is subject to a terminal disclaimer.

(21) Appl. No.: 16/610,263

(22) PCT Filed: May 3, 2018

(86) PCT No.: PCT/EP2018/061279

§ 371 (c)(1),
(2) Date: Nov. 1, 2019

(87) PCT Pub. No.: WO2018/202743

PCT Pub. Date: Nov. 8, 2018

(65) Prior Publication Data

US 2021/0102137 A1 Apr. 8, 2021

(30) Foreign Application Priority Data

May 4, 2017 (FR) ..... 1753919

(51) Int. Cl.
*C10M 133/06* (2006.01)
*C10N 30/00* (2006.01)
(Continued)

(52) U.S. Cl.
CPC ..... *C10M 133/06* (2013.01); *C10M 2215/04* (2013.01); *C10N 2030/04* (2013.01); *C10N 2030/76* (2020.05); *C10N 2040/25* (2013.01)

(58) Field of Classification Search
CPC ..... C10M 2215/26; C10M 2217/046; C10M 2203/003; C10M 159/12; C10M 149/22;
(Continued)

(56) References Cited

U.S. PATENT DOCUMENTS 3,544,466 A 12/1970 Mcdowell et al.
2011/0092403 A1 4/2011 Lancon et al.
(Continued)

FOREIGN PATENT DOCUMENTS

GB 973679 10/1964

OTHER PUBLICATIONS

International Search Report for International Application No. PCT/EP2018/061279, dated Jun. 18, 2018, European Patent Office, Rijswijk, NL.

(Continued)

*Primary Examiner* — Vishal V Vasisth
(74) *Attorney, Agent, or Firm* — B. Aaron Schulman, Esq.; Stites & Harbison, PLLC

(57) ABSTRACT

The invention relates to the use of one or more fatty amines that are soluble in a lubricant composition comprising at least one detergent in order to reduce and/or control the abnormal combustion of gas in a marine engine, the amine/detergent weight 1-1 ratio being between 0.01 and 0.5. The invention also relates to a process for reducing and/or controlling the abnormal combustion of gas in a marine engine in which the gas is in contact with one or more fatty amines that are soluble in a lubricant composition comprising at least one detergent, the amine/detergent weight ratio being between 0.01 and 1, preferably between 0.01 and 0.9,
(Continued)

Figure 1:
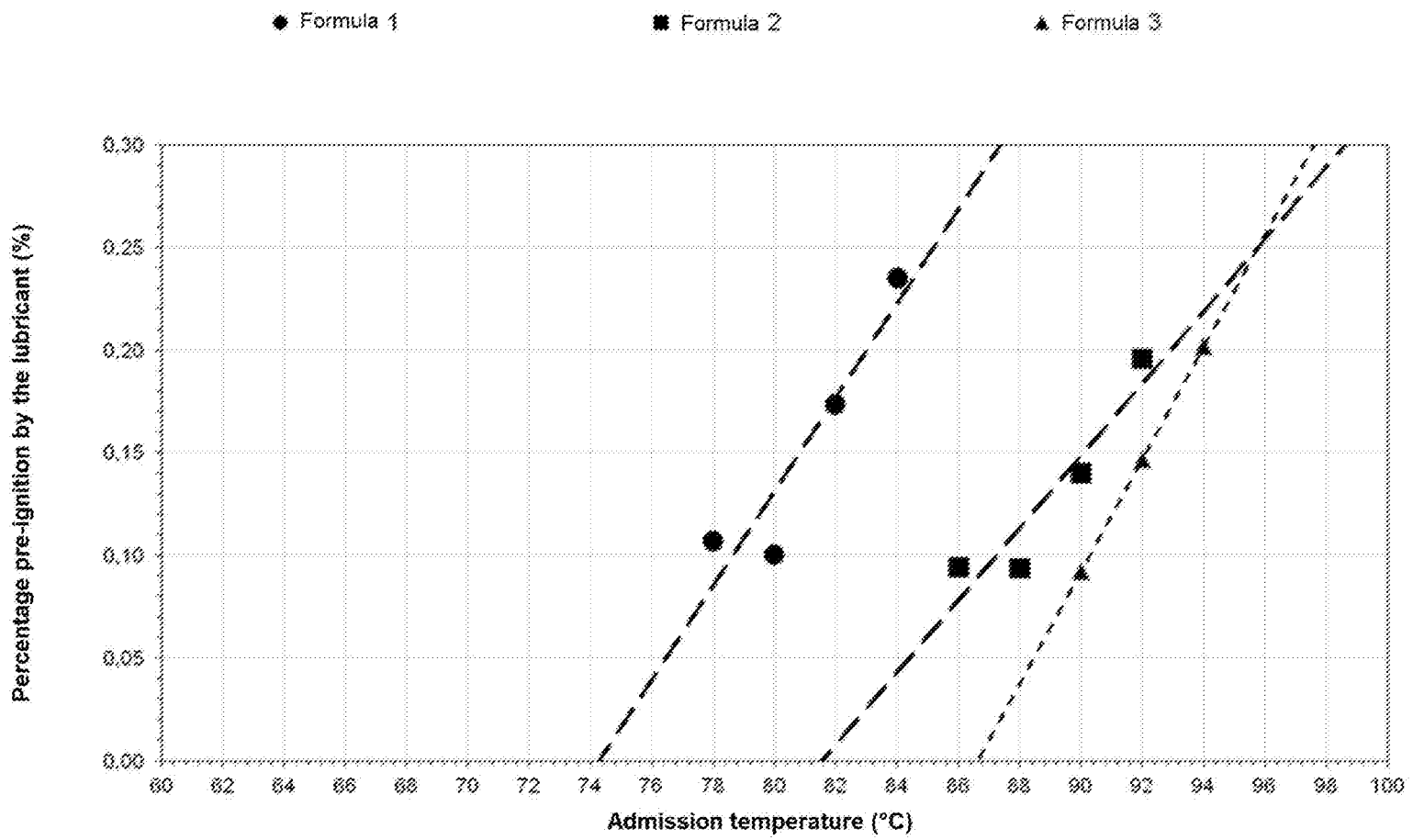

more preferentially between 0.02 and 0.8, for example between 0.03 and 0.8, in particular between 0.01 and 0.5, preferably between 0.01 and 0.4, for el example between 0.02 and 0.4.

12 Claims, 3 Drawing Sheets

(51) Int. Cl.
*C10N 30/04* (2006.01)
*C10N 40/25* (2006.01)

(58) Field of Classification Search
CPC ..... C10M 169/041; C10N 2040/26; C10N 2010/04; C10N 2060/14
See application file for complete search history.

(56) References Cited

U.S. PATENT DOCUMENTS

| | | | | |
|---|---|---|---|---|
| 2014/0041610 | A1* | 2/2014 | Lancon | C10M 159/20 123/1 A |
| 2016/0177216 | A1 | 6/2016 | Lancon et al. | |
| 2016/0251590 | A1* | 9/2016 | Lundgren | C10M 133/06 508/556 |
| 2017/0313955 | A1 | 11/2017 | Doyen | |
| 2018/0223218 | A1 | 8/2018 | Doyen et al. | |
| 2018/0371356 | A1 | 12/2018 | Roussel | |

OTHER PUBLICATIONS

Written Opinion for International Application No. PCT/EP2018/061279, dated Jun. 18, 2018, European Patent Office, Rijswijk, NL. English translation of Written Opinion dated Jun. 27, 2018 in International Application No. PCT/EP2018/061279.

* cited by examiner

USE OF A FATTY AMINE FOR REDUCING AND/OR CONTROLLING THE ABNORMAL COMBUSTION OF GAS IN A MARINE ENGINE

This application is a 371 of PCT/EP2018/061279, filed May 3, 2018.

The present invention concerns the reducing and/or controlling of abnormal gas combustion in a marine engine.

The subject of the present invention is the use of one or more fatty amines soluble in a lubricant composition to reduce and/or control abnormal gas combustion in a marine engine.

A further subject of the present invention is a process for reducing and/or controlling abnormal gas combustion in a marine engine, wherein the gas is in contact with one or more fatty amines soluble in a lubricant composition.

A further subject of the invention is a lubricant composition and use thereof to reduce and/or control abnormal gas combustion in a marine engine.

The marine propulsion industry is working towards increasing the efficacy of gas-operated marine engines which have come to operate under ever increasing operating loads. However, low speed of rotation associated with high loads promotes the onset of abnormal combustion phenomena possibly causing destruction of the engine. Pre-ignition, characterized by autoignition of the air-gas premix before the normal ignition command, leads to an abnormal increase in pressure in the gas engine cylinder.

In general, combustion of the gas or more specifically of the air-gas mixture in a marine engine is initiated by controlled ignition derived either from contact between an electric arc and the gas, or via piloted injection of liquid fuel initiating a propagating flame. Controlled ignition can be obtained directly in the combustion chamber of the marine engine or in a pre-combustion chamber of the marine engine adjoining the engine's combustion chamber.

Controlled gas combustion is the term used when it is directly initiated by controlled ignition. This controlled combustion is generally characterized by controlled expansion of the flame front throughout the combustion chamber. Controlled combustion can also be called normal combustion.

However, in some cases, the air-gas mixture can autoignite prematurely before controlled ignition, in particular through autoignition of the lubricant composition in the combustion chamber. In this case, it is termed a phenomenon of uncontrolled pre-ignition. This uncontrolled pre-ignition phenomenon translates as abnormal gas combustion characterized by uncontrolled expansion of the flame front throughout the combustion chamber.

This abnormal gas combustion generates a strong increase in temperature and pressure in the combustion chamber. It has been ascertained that these conditions of abnormally high temperature and pressure have a significant negative impact on the efficiency and overall performance of a marine engine, and can go as far causing irreversible damage to the engine's internal parts: cylinders, pistons, spark plugs and valves in the marine engine.

The use of amines in the lubricant composition is known in particular from U.S. Pat. No. 3,544,466, in the field of 2-stroke engines specific in that the lubricant is pre-mixed with the gasoline before admission into the engine. The use of amines in lubricant compositions is also known from GB973679 to improve engine lubrication. The application concerned relates to 2-stroke gasoline engines in which the lubricant is mixed with the gasoline before admission into the engine. These former generations of engines differ greatly from current marine engines which do not require pre-mixing of lubricant with the fuel before admission. These two patent applications therefore concern most specific engines in terms of engine design, admission of lubricant pre-mixed with fuel, and lubrication system.

Throughout its research, the Applicant has put forward that abnormal gas combustion can be derived inter alia from autoignition of the lubricant composition during the gas compression cycle and/or combustion of the gas when a marine engine is in operation.

There is therefore a need to provide a lubricant composition able to overcome all or some of the aforementioned shortcomings.

Lubricant compositions for marine engines conventionally comprise detergents.

The Applicant has surprisingly discovered that the presence of fatty amines soluble in a lubricant composition in a specific weight ratio to detergents allows the reducing and/or controlling of abnormal gas combustion in a marine engine.

The fatty amines comprised in a lubricant composition are known as such in applications WO 2009/153453 and WO 2014/180843 filed by the applicant. The applicant has now discovered a novel use of these fatty amines.

The Applicant has therefore observed that the use of one or more soluble fatty amines in a specific weight ratio in relation to detergents in a lubricant composition allows the reducing and/controlling of abnormal gas combustion in a marine engine.

By «abnormal combustion» it is meant gas combustion in the combustion chamber initiated by uncontrolled pre-ignition. Abnormal combustion translates as uncontrolled expansion of the flame front throughout the combustion chamber. Abnormal combustion also translates as a pressure level in the combustion chamber that is higher by at least 10%, preferably at least 20%, more preferably a least 30 compared with the nominal pressure of gas combustion in a marine engine.

By «nominal pressure» it is meant the maximum pressure withstood by the engine parts during controlled gas combustion in the combustion chamber without risk of degrading all or some of the engine internal parts e.g. cylinders, pistons, spark plugs and valves.

By «gas» it is meant a mixture of gas and air. In the meaning of the invention, the mixture of gas and air is formed upstream of the combustion chamber or in the combustion chamber before ignition of the marine engine. The step allowing the gas and air mixture to be obtained is called the premix step. In the meaning of the invention, the terms «gas» and «gas and air mixture» have equivalent meanings and can be used in replacement of each other.

The term «homogeneous gas combustion» is used when the gas is pre-mixed with air. In the meaning of the invention, the terms «gas combustion», «combustion of the gas and air mixture», «homogeneous gas combustion» or «homogeneous combustion of the gas and air mixture» have equivalent meanings and can be used in replacement of each other.

By «marine engine» it is meant a two-stroke or four-stroke marine engine that is solely gas-operated, also called a pure gas engine, or operating with gas and fuel and also called a dual fuel engine.

The engines of the invention are particularly 2-stroke or 4-stroke engines in which the lubricant is not pre-mixed with the fuel before admission.

A first subject of the invention concerns the use of one or more fatty amines soluble in a lubricant composition comprising at least one detergent to reduce and/or control abnormal gas combustion in a marine engine, the amine/detergent weight ratio being between 0.01 and 1, preferably between 0.01 and 0.9, more preferably between 0.02 and 0,8 for example between 0.03 and 0.8, in particular between 0.01 and 0.5, preferably between 0.01 and 0.4, for example between 0.02 and 0.4.

In the present invention, by «between xxx and yyy» it is meant that the values xxx and yyy are included in the range.

In one particular embodiment of the invention, the fatty amine is selected from among:

amines of formula (I):

$$R_1—[(NR_2)—R_3]_q—NR_4R_5, \quad (I)$$

where:

$R_1$ is a saturated or unsaturated, linear or branched hydrocarbon group having at least 12 carbon atoms, and optionally at least one heteroatom selected from among nitrogen, sulfur or oxygen;

$R_2$, $R_4$ or $R_5$ are independently a hydrogen atom or saturated or unsaturated, linear or branched hydrocarbon group and optionally comprising at least one heteroatom selected from among nitrogen, sulfur or oxygen;

$R_3$ is a saturated or unsaturated, linear or branched hydrocarbon group having one or more carbon atoms and optionally comprising at least one heteroatom selected from among nitrogen, sulfur or oxygen, preferably oxygen;

q is equal to or higher than 0, preferably q is 1 or higher, more preferably it is an integer of between 1 and 10, further preferably between 1 and 6, advantageously it is selected from among 1, 2 or 3;

a mixture of fatty polyalkylamines comprising one or more polyalkylamines of formulas (III) and/or (IV):

(III)

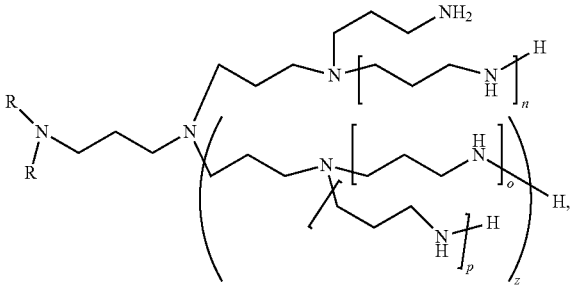

(IV)

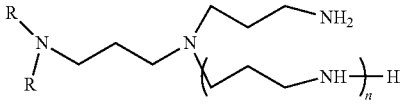

where:

R, the same or different, is a linear or branched alkyl group having 8 to 22 carbon atoms;

n and z, each independently, are 0, 1, 2 or 3; and when z is higher than 0, o and p are each independently 0, 1, 2 or 3, said mixture comprising at least 3 weight % of branched compounds such that at least one of n or z is 1 or higher, or derivatives thereof, or the mixtures of fatty amines of formulas (I), (Ill) and/or (IV).

Advantageously, the fatty amine (is) of formula (I):

$$R_1—[(NR_2)—R_3]_q—NR_4R_5,$$

where:

$R_1$ is a saturated or unsaturated, linear or branched alkyl group having 12 to 22 carbon atoms, preferably 14 to 22 carbon atoms, and optionally at least one heteroatom selected from among nitrogen, sulfur or oxygen; and/or $R_2$, $R_4$ or $R_5$ are independently a hydrogen atom, a saturated or unsaturated, linear or branched alkyl group having between 1 and 22 carbon atoms, preferably between 14 and 22 carbon atoms, more preferably between 16 and 22 carbon atoms; or a $(R_6—O)_r—H$ group where $R_6$ is a saturated, linear or branched alkyl group having at least 2 carbon atoms, preferably between 2 and 6 carbon atoms, more preferably between 2 and 4 carbon atoms, and r is an integer of 1 or higher, preferably between 1 and 6, more preferably between 1 and 4; and/or $R_3$ is a saturated or unsaturated, linear or branched alkyl group having between 2 and 6 carbon atoms, preferably between 2 and 4 carbon atoms.

More preferably, the fatty amine is of formula (I) where:

q is 1, 2 or 3;

$R_1$ is a saturated or unsaturated, linear or branched alkyl group having 12 to 20 carbon atoms, preferably 14 to 20 carbon atoms, and optionally at least one heteroatom selected from among nitrogen, sulfur or oxygen;

$R_2$ is independently a hydrogen atom or saturated, linear or branched alkyl group having 1 to 20 carbon atoms, preferably 16 to 20 carbon atoms, more preferably 16 to 18 carbon atoms;

$R_3$ is a saturated, linear alkyl group having between 2 and 6 carbon atoms, preferably between 2 and 4 carbon atoms;

$R_4$ and $R_5$ are a hydrogen atom or methyl group, preferably a hydrogen atom.

Advantageously, the fatty amine is of formula (I) where:

q is equal to 3;

$R_1$ is a saturated or unsaturated, linear or branched alkyl group having 12 to 20 carbon atoms, preferably 14 to 20 carbon atoms, more preferably 16 to 20 carbon atoms, and optionally at least one heteroatom selected from among nitrogen, sulfur or oxygen;

$R_2$ is independently a hydrogen atom or saturated, linear or branched alkyl group having 16 to 18 carbon atoms;

$R_3$ is an ethyl or propyl group;

$R_4$ and $R_5$ are a hydrogen atom.

More preferably, the fatty amine is also of formula (I) where:

q is 1, 2 or 3;

$R_1$ is a saturated or unsaturated, linear or branched alkyl group having 14 to 20 carbon atoms, preferably 16 to 20 carbon atoms;

$R_2$, $R_4$ and $R_5$ are independently a hydrogen atom or $(R_6—O)_r—H$ group where $R_6$ is a saturated, linear alkyl group having between 2 and 6 carbon atoms, preferably between 2 and 4 carbon atoms, and r being an integer of between 1 and 6, preferably between 1 and 4;

$R_3$ is a saturated, linear alkyl group having between 2 and 6 carbon atoms, preferably between 2 and 4 carbon atoms.

Advantageously, the fatty amine is also of formula (I) where:

q is equal to 3;

$R_1$ is a saturated or unsaturated, linear or branched alkyl group having 14 to 20 carbon atoms, preferably 16 to 20 carbon atoms;

$R_2$, $R_4$ and $R_5$ are independently a hydrogen atom or $(R_6—O)_r—H$ group where $R_6$ is a saturated, linear alkyl group having between 2 and 4 carbon atoms and r being n integer of between 1 and 4;

$R_3$ is an ethyl or propyl group.

Preferably, the fatty amine is a mixture of fatty polyalkylamines comprising one or more polyalkylamines of formulas (III) and/or (IV):

(III)

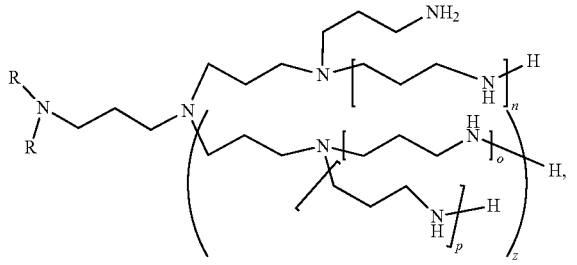

(IV)

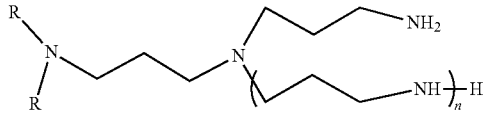

where:

R, the same or different, is a linear or branched alkyl group having 8 to 22 carbon atoms;

n and z are each independently 0, 1, 2 or 3; and when z is higher than 0, o and p are each independently 0, 1, 2 or 3, said mixture comprising at least 3 weight % of branched compounds such that at least one or n or z is 1 or higher, or the derivatives thereof.

In one particular embodiment of the invention, the fatty amine represents from 0.1 to 10 weight % relative to the total weight of the lubricant composition, preferably 0.1 to 6%, for example 0.5 to 6%.

In another particular embodiment of the invention, the marine engine is a pure gas or dual fuel engine, two-stroke or four-stroke.

In another particular embodiment of the invention, the use of one or more fatty amines soluble in a lubricant composition allows the reducing and/or controlling of abnormal gas combustion in a marine engine, caused by auto ignition of the lubricant composition.

In another particular embodiment of the invention, the use of one or more fatty amines soluble in a lubricant composition allows the reducing and/or controlling of abnormal gas combustion of any type of gas, in particular gases having a low methane number (MN), preferably a methane number lower than 80, more advantageously lower than 60.

DETAILED DESCRIPTION OF THE INVENTION

Fatty Amine

The fatty amines of the invention soluble in a lubricant composition allow the reducing and/or controlling of abnormal gas combustion in a marine engine.

In one particular embodiment of the invention, the fatty amine is of formula (I):

$$R_1—[(NR_2)—R_3]_q—NR_4R_5,$$

where:

$R_1$ is a saturated or unsaturated, linear or branched hydrocarbon group having at least 12 carbon atoms, and optionally at least one heteroatom selected from among nitrogen, sulfur or oxygen;

$R_2$, $R_4$ or $R_5$ are independently a hydrogen atom or saturated or unsaturated, linear or branched hydrocarbon group, and optionally comprising at least one heteroatom selected from among nitrogen, sulfur or oxygen;

$R_3$ is a saturated or unsaturated, linear or branched hydrocarbon group comprising one or more carbon atoms, and optionally comprising at least one heteroatom selected from among nitrogen, sulfur or oxygen;

q is equal to 0 or higher, preferably q is 1 or higher, more preferably it is an integer of between 1 and 10, more preferably between 1 and 6, advantageously it is selected from among 1, 2 or 3.

By «fatty amine» according to the invention it is meant an amine comprising one or more saturated or unsaturated, linear or branched hydrocarbon groups and optionally comprising at least one heteroatom selected from among nitrogen, sulfur or oxygen, preferably oxygen. For example, the fatty amine of the invention can be an amine of formula (I).

By «or more fatty amines» according to the invention it is meant a mixture of fatty amines of which at least one fatty amine is of formula (I).

Preferably, the fatty amine is of formula (I) where:

$R_1$ is a saturated or unsaturated, linear or branched alkyl group having 12 to 22 carbon atoms, preferably 14 to 22 carbon atoms, and optionally at least one heteroatom selected from among nitrogen, sulfur or oxygen; and/or $R_2$, $R_4$ or $R_5$ are independently a hydrogen atom, or a saturated or unsaturated, linear or branched alkyl group having between 1 and 22 carbon atoms, preferably between 14 and 22 carbon atoms, more preferably between 16 and 22 carbon atoms; or a $(R_6—O)_r—H$ group where $R_6$ is a saturated, linear or branched alkyl group having at least 2 carbon atoms, preferably between 2 and 6 carbon atoms, more preferably between 2 and 4 carbon atoms, and r is an integer of 1 or higher, preferably of between 1 and 6, more preferably between 1 and 4; and/or $R_3$ is a saturated or unsaturated, linear or branched alkyl group, having between 2 and 6 carbon atoms, preferably between 2 and 4 carbon atoms.

Advantageously, the fatty amine is of formula (I) where:

q is 1, 2 or 3;

$R_1$ is a saturated or unsaturated, linear or branched alkyl group having 14 to 20 carbon atoms, preferably 16 to 20 carbon atoms, and optionally at least one heteroatom selected from among nitrogen, sulfur or oxygen;

$R_2$ is independently a hydrogen atom or a saturated, linear or branched alkyl group having 1 to 20 carbon atoms, preferably 16 to 20 carbon atoms, more preferably 16 to 18 carbon atoms;

$R_3$ is a saturated, linear alkyl group having between 2 and 6 carbon atoms, preferably between 2 and 4 carbon atoms;

$R_4$ and $R_5$ are a hydrogen atom or methyl group, preferably a hydrogen atom.

In particular, the fatty amine is of formula (I) where:

q is equal to 3;

$R_1$ is a saturated or unsaturated, linear or branched alkyl group having 14 to 20 carbon atoms, preferably 16 to 20 carbon atoms, and optionally at least one heteroatom selected from among nitrogen, sulfur or oxygen;

$R_2$ is independently a hydrogen atom or a saturated, linear or branched alkyl group having 16 to 18 carbon atoms;

$R_3$ is an ethyl or propyl group;

$R_4$ and $R_5$ are a hydrogen atom.

Advantageously, the fatty amine is of formula (I) where:

q is 1, 2 or 3;

$R_1$ is a saturated or unsaturated, linear or branched alkyl group having 14 to 20 carbon atoms, preferably 16 to 20 carbon atoms;

$R_2$, $R_4$ and $R_5$ are independently a hydrogen atom or $(R_6—O)_r—H$ group where $R_6$ is a saturated, linear alkyl group having between 2 and 6 carbon atoms, preferably between 2 and 4 carbons atoms and r being an integer of between 1 and 6, more preferably of between 1 and 4;

$R_3$ is a saturated, linear alkyl group having between 2 and 6 carbon atoms, preferably between 2 and 4 carbon atoms.

In particular, the fatty amine is of formula (I) where:

q is equal to 3;

$R_1$ is a saturated or unsaturated, linear or branched alkyl group having 14 to 20 carbon atoms, preferably 16 to 20 carbon atoms;

$R_2$, $R_4$ and $R_5$ are independently a hydrogen atom or $(R_6—O)_r—H$ group where R6 is a saturated, linear alkyl group having between 2 and 4 carbon atoms and p being an integer of between 1 and 4;

$R_3$ is an ethyl or propyl group.

In general, the fatty amines of the invention are chiefly obtained from carboxylic acids. These acids are dehydrated in the presence of ammonia to yield nitriles, and then undergo catalytic hydrogenation leading in particular to fatty amines.

In the meaning of the invention, the fatty amine of formula (I) is obtained from at least one carboxylic acid, preferably at least one fatty acid.

In the meaning of the invention, the alkyl group of the fatty amine has a number of carbon atoms corresponding to the number of carbon atoms of the carbon chain of the carboxylic acid, preferably corresponding to the number of carbon atoms of the carbon chain of the fatty acid.

In the meaning of the invention, one same fatty amine of formula (I) can be substituted by several alkyl groups obtained from several same or different carboxylic acids, preferably obtained from several same or different fatty acids.

In one particular embodiment of the invention, the alkyl group is obtained from fatty acids selected from among caprylic, pelargonic, capric, undecylenic, lauric, tridecylenic, myristic, pentadecanoic, palmitic, margaric, stearic, nonadecanoic, arachidic, heneicosanoic, behenic, tricosanoic, lignoceric, pentacosanoic, cerotic, heptacosanoic, montanic, nonacosanoic, melissic, hentriacontanoic, lacceroic acids and derivatives thereof, or from unsaturated fatty acids such as palmitoleic, oleic, erucic, nervonic, linoleic, a-linolenic, c-linolenic, di-homo-c-linolenic, arachidonic, eicosapentaenoic, docosahexaenoic acids, and derivatives thereof.

Preferably, the fatty acids are derived from hydrolysis of the triglycerides contained in vegetable or animal oils, such as copra, palm, olive, groundnut, rapeseed, sunflower seed, soy, cotton, flax oils, beef tallow. Natural oils may have been genetically modified to enrich their content of some fatty acids e.g. rapeseed oil or oleic sunflower.

In general, the fatty amine of formula (I) of the invention is preferably obtained from natural vegetable or animal resources. Treatments resulting in fatty amines from natural oils can lead to mixtures of primary, secondary and tertiary polyamines.

In another particular embodiment of the invention, when several fatty amines are used to reduce and/or control abnormal gas combustion in a marine engine, said fatty amines form a mixture of fatty amines comprising in variable proportions all or part of the compounds meeting following formulas (Ia), (Ib), (Ic) and (Id):

$$R_1—NR_4R_5 \quad \text{(Ia)},$$

$$R_1—[(NR_2)—R_3]—NR_4R_5 \quad \text{(Ib)},$$

$$R_1—[(NR_2)—R_3]_2—NR_4R_5 \quad \text{(Ic)},$$

$$R_1—[(NR_2)—R_3]_3—NR_4R_5 \quad \text{(Id)}$$

where:

$R_1$ is a saturated or unsaturated, linear or branched hydrocarbon group having at least 12 carbon atoms, and optionally at least one heteroatom selected from among nitrogen, sulfur or oxygen;

$R_2$, $R_4$ or $R_5$ are independently a hydrogen atom or a saturated or unsaturated, linear or branched hydrocarbon group and optionally comprising at least one heteroatom selected from among nitrogen, sulfur or oxygen;

$R_3$ is a saturated or unsaturated, linear or branched hydrocarbon group, having one or more carbon atoms, and optionally comprising at least one heteroatom selected from among nitrogen, sulfur or oxygen, preferably oxygen.

The preferences and advantages for the definitions of groups $R_1$, $R_2$, $R_3$, $R_4$, $R_5$ and $R_6$ of the fatty amines of formulas (Ia), (Ib), (Ic) and (Id) are such as defined in the foregoing for the fatty amine of formula (I) of the invention.

In another particular embodiment, the mixture of fatty amines is in purified form i.e. mostly comprising a single type of amine of formula (Ia), (Ib), (Ic) ou (Id), e.g. mostly monoamines of formula (Ia), diamines of formula (Ib), triamines of formula (Ic) or mostly tetramines of formula (Id). In particular, the mixture of fatty amines mostly comprises tetramines of formula (Id).

In one particular embodiment of the invention, the mixture of fatty mines mostly comprises:

monoamines of formula (Ia), or
diamines of formula (Ib), or
triamines of formula (Ic), or
tetramines of formula (Id), where the groups $R_1$, $R_2$, $R_3$, $R_4$, $R_5$ and $R_6$ are such as defined above.

In another embodiment of the invention, the mixture of fatty amines mostly comprises monoamines of formula (Ia) where:

$R_1$ is a saturated or unsaturated, linear or branched alkyl group having 12 to 20 carbon atoms, preferably 14 to 20 carbon atoms, more preferably 16 to 20 carbon atoms;

$R_4$ and $R_5$ are independently a hydrogen atom or a saturated, linear or branched alkyl group having 1 to 5 carbon atoms, preferably 1 to 3 carbon atoms, more preferably a methyl group.

In another embodiment of the invention, the mixture of fatty amines mostly comprises diamines of formula (Ib) where:

$R_1$ is a saturated or unsaturated, linear or branched alkyl group having 12 to 20 carbon atoms, preferably 14 to 20 carbon atoms, more preferably 16 to 20 carbon atoms;

$R_2$ is a saturated, linear or branched alkyl group having 1 to 5 carbon atoms, preferably 1 to 3 carbon atoms, more preferably a methyl group;

$R_3$ is an ethyl or propyl group;

$R_4$ and R5 are independently a hydrogen atom or a saturated, linear or branched alkyl group having 1 to 5 carbon atoms, preferably 1 to 3 carbon atoms, more preferably a methyl group.

Preferably, the mixture of fatty amines mostly comprises monoamines of formula $R_1$—$NH_2$ (IIa), diamines of formula $R_1$—[($NR_2$)-$R_3$]—$NH_2$ (IIb), triamines of formula $R_1$—[($NR_2$)—$R_3$]$_2$—$NH_2$ (IIc), or tetramines of formula $R_1$—[($NR_2$)—$R_3$]$_3$—$NH_2$ (IId), where:

$R_1$ or $R_2$ are at least a saturated or unsaturated alkyl group, obtained from a fatty acid derived from tallow fat, or from soy oil, or coconut oil or (oleic) sunflower seed oil;

$R_3$ is a saturated or unsaturated, linear or branched hydrocarbon group having at least 2 carbon atoms.

In the meaning of the invention, when $R_1$ or R2 are a saturated alkyl group, said saturated alkyl is obtained from a saturated fatty acid or from an unsaturated fatty acid subjected to hydrogenation, in particular from all these double bonds.

Advantageously, the mixture of fatty amines mostly comprising tetramines of formula $R_1$—[($NR_2$)—$R_3$]$_3$—$NH_2$ (IId) is in the form of:

at least one fatty amine of formula (IId) where $R_1$ is a saturated or unsaturated, linear or branched alkyl group having 14 to 16 carbon atoms; $R_2$ is a hydrogen atom; and $R_3$ is a saturated, linear alkyl group having 2 to 6 carbon atoms;

at least one fatty amine of formula (IId) where $R_1$ is a saturated or unsaturated, linear or branched alkyl group having at least 18 carbon atoms; $R_2$ is a hydrogen atom; and $R_3$ is a saturated, linear group having 2 to 6 carbon atoms; and at least one fatty amine of formula (IId) where $R_1$ is a saturated or unsaturated, linear or branched alkyl group having at least 20 carbon atoms, $R_2$ is a hydrogen atom; and $R_3$ is a saturated, linear alkyl group having 2 to 6 carbon atoms.

In particular, the mixture of fatty amines mostly comprising tetramines of formula $R_1$—[($NR_2$)—$R_3$]$_3$—$NH_2$ (IId) is in the form of:

at least one fatty amine of formula (IId) where $R_1$ is a saturated or unsaturated, linear or branched alkyl group having 14 to 16 carbon atoms; $R_2$ is a hydrogen atom; and $R_3$ is a saturated, linear alkyl group having 2 to 6 carbon atoms;

at least one fatty amine of formula (IId) where $R_1$ is a saturated or unsaturated, linear or branched alkyl group having at least 18 carbon atoms; R2 is a hydrogen atom; and $R_3$ is a saturated, linear alkyl group having 2 to 6 carbon atoms; and at least one fatty amine of formula (IId) where $R_1$ is a saturated or unsaturated, linear or branched alkyl group having at least 20 carbon atoms; $R_2$ is a hydrogen atom; and $R_3$ is a saturated, linear alkyl group having 2 to 6 carbon atoms, the sum of the weight content of said fatty amines of formula (IId) being higher than 90% relative to the weight of said mixture of fatty amines.

Advantageously, the mixture of fatty amines mostly comprising tetramines of formula $R_1$—[($NR_2$)—$R_3$]$_3$—$NH_2$ (IId) is also in the form of:

at least one fatty amine of formula (IId) where $R_1$ is an unsaturated, linear or branched alkyl group having 16 to 20 carbon atoms, preferably 18 to 20 carbon atoms; $R_2$ is a hydrogen atom; and $R_3$ is a saturated, linear alkyl group having 2 to 6 carbon atoms; and at least one fatty amine of formula (IId) where $R_1$ is a saturated, linear or branched alkyl group having 16 to 20 carbon atoms, preferably 18 to 20 carbon atoms; $R_2$ is a hydrogen atom; and $R_3$ is a saturated, linear alkyl group having 2 to 6 carbon atoms.

In particular, the mixture of fatty amines mostly comprising tetramines of formula $R_1$—[($NR_2$)—$R_3$]$_3$—$NH_2$ (IId) is in the form of:

at least one fatty amine of formula (IId) where $R_1$ is an unsaturated, linear or branched alkyl group having 16 to 20 carbon atoms, preferably 18 to 20 carbon atoms; $R_2$ is a hydrogen atom; and $R_3$ is a saturated, linear alkyl group having 2 to 6 carbon atoms;

at least one fatty amine of formula (IId) where $R_1$ is a saturated, linear or branched alkyl group having 16 to 20 carbon atoms, preferably 18 to 20 carbon atoms; $R_2$ is a hydrogen atom; and $R_3$ is a saturated, linear alkyl group having 2 to 6 carbon atoms.

the sum of the weight content of said fatty amines of formula (IId) being higher than 90% relative to the weight of said mixture of fatty amines.

Preferably, the mixture of fatty amines does not comprise fatty amines other than the fatty amines meeting formula (IId).

In one particular embodiment of the invention, when only one fatty amine is used to reduce and/or control abnormal gas combustion in a marine engine, said fatty amine meets one of the following formulas:

a monoamine of formula (IIa), or a diamine of formula (IIb), or a triamine of formula (IIc), or a tetramine of formula (IId), where:

$R_1$ is a saturated, linear or branched hydrocarbon group having at least 14 carbon atoms;

$R_2$ is independently a hydrogen atom or a saturated, linear or branched hydrocarbon group having at least 14 carbon atoms;

$R_3$ is a saturated, linear hydrocarbon group having at least 2 carbon atoms.

In this embodiment, the fatty amine is preferably a tetramine of formula (IId) where:

$R_1$ is a saturated, linear or branched alkyl group having between 14 and 18 carbon atoms;

$R_2$ is independently a hydrogen atom or a saturated, linear or branched hydrocarbon group having between 14 and 18 carbon atoms;

$R_3$ is a saturated, linear hydrocarbon group having between 2 and 6 carbon atoms.

In this embodiment, the fatty amine is advantageously a tetramine of formula (IId) where:

$R_1$ is a saturated, linear or branched alkyl group having between 16 and 18 carbon atoms;

$R_2$ is independently a hydrogen atom or a saturated, linear or branched hydrocarbon group having between 16 and 18 carbon atoms;

$R_3$ is an ethyl or propyl group.

Preferably, when the fatty amine is a mixture of polyalkylamines of formulas (III) and/or (IV), the mixtures of polyalkylamines comprise at least 5 weight % of compounds having a pure linear structure, since these compounds have proved to have an acceptable viscosity profile, in particular increased acceptable viscosity when the lubricant comprising this mixture of polyalkylamines of formulas (III) and/or (IV) is in use.

In one embodiment, when the fatty amine is a mixture of polyalkylamines of formulas (III) and/or (IV), the mixtures of polyalkylamines comprise at least 4 weight % (% w/w), preferably at least 5% w/w, preferably at least 6% w/w, preferably more than 7% w/w, preferably more than 7.5% w/w, preferably more than 10% w/w, preferably more than 20% w/w of branched compounds in which at least one of n or z is equal to or higher than 1.

For the products of formula (III), this means that for the branched products, n must be equal to or higher than 1.

Preferably, when the fatty amine is a mixture of polyalkylamines of formulas (III) and/or (IV), when n, o, p or z equals 0, the hydrogen atom present at the end of the chain is covalently bonded to the corresponding secondary nitrogen atom.

Preferably, when the fatty amine is a mixture of polyalkylamines of formulas (III) and/or (IV), the mixture comprises compounds of formulas (III) and/or (IV) where n, o, p and z, when they differ from 0, are equal to 1 or 2, preferably when n, o, p and z differ from 0 they are equal to 1.

In one preferred embodiment, when the fatty amine is a mixture of polyalkylamines of formulas (III) and/or (IV), the mixture essentially comprises compounds of formulas (III) and/or (IV) where n, o, p or z are independently 0, 1 or 2, preferably n, o, p or z are independently 0 or 1.

In one preferred embodiment, when the fatty amine is a mixture of polyalkylamines of formulas (III) and/or (IV), the mixture essentially comprises compounds of formulas (III) and/or (IV) and the derivatives thereof where n, o, p and z are independently 0, 1 or 2, preferably n, o, p and z are independently 0 or 1.

The derivatives of the compounds of formulas (III) and/or (IV) are described below.

In one preferred embodiment, each R group is each independently a linear or branched alky group, and has 14 to 22 carbon atoms, preferably 14 to 20 carbon atoms, preferably 16 to 20 carbon atoms.

In general, the fatty amines of formula (III) and (IV) according to the invention are chiefly obtained from carboxylic acids. These acids are dehydrated in the presence of ammonia to yield nitriles, and then undergo catalytic hydrogenation leading in particular to fatty amines.

In the meaning of the invention, the fatty amines of formula (III) and (IV) are obtained from at least one carboxylic acid, preferably from at least one fatty acid.

In the meaning of the invention, the alkyl group of the fatty amines of formula (III) and (IV) have a number of carbon atoms corresponding to the number of carbon atoms of the carbon chain of the carboxylic acid, preferably corresponding to the number of carbon atoms of the carbon chain of the fatty acid.

In one particular embodiment of the invention, when the fatty amine is a mixture of polyalkylamines of formulas (III) and/or (IV), the alkyl group R is obtained from a fatty acid selected from among caprylic, pelargonic, capric, undecylenic, lauric, tridecylenic, myristic, pentadecanoic, palmitic, margaric, stearic, nonadecanoic, arachidic, heneicosanoic, behenic, tricosanoic, lignoceric, pentacosanoic, cerotic, heptacosanoic, montanic, nonacosanoic, melissic, hentriacontanoic, lacceroic acids, and the derivatives thereof, or from unsaturated fatty acids such as palmitoleic, oleic, erucic, nervonic, linoleic, a-linolenic, c-linolenic, dihomo-c-linolenic, arachidonic, eicosapentaenoic, docosahexaenoic acids, and the derivatives thereof.

Preferably, the fatty acids are derived from hydrolysis of the triglycerides contained in vegetable and animal oils, such as copra, palm, olive, groundnut, rapeseed, sunflower seed, soy, cotton, flax oils, beef tallow. Natural oils may have been genetically modified to enrich their content of some fatty acids e.g. rapeseed oil or oleic sunflower oil.

The compositions of derivatives of fatty di-alkyl polyalkylamines of formulas (III) and/or (IV) of the invention comprise compounds in which one or more NH fragments of the fatty polyalkylamine of the invention are methylated, alkoxylated or both. It has been discovered that such compounds have advantageous solubility, in particular in lubricant oils. Advantageously, the alkoxylated derivatives are butoxylated, propoxylated and/or ethoxylated. If two or more alkoxylating agents are used, they can be used in any order e.g. EO—PO—EO, and the different alkoxy units can be of polyhedral type and/or randomly present. Advantageously, a primary —NH2 group is alkoxylated with one or more alkylene oxides in conventional manner to form a group —NH—AO—H, where AO represents one or more alkylene-oxy repeating units. The —NH—AO—H group obtained can also be alkoxylated to form $—N(AO—H)_2$ repeating units. In particular, when large quantities of alkylene oxide are used (i.e. more than 8 moles of alkylene oxide per mole of polyalkylamine), one or more secondary amines, if present, are generally alkoxylated.

In one embodiment, all the primary and secondary amine functions of the di-alkyl polyamine of formulas (III) and/or (IV) are alkoxylated. In another embodiment, the fatty di-alkyl polyalkylamines are obtained by methylation of one or more NH functions in manner known to persons skilled in the art, for example by reaction with formic acid and formaldehyde. In one embodiment, one or more OH functions of the alkoxylated fatty di-alkyl polyalkylamines are methylated in conventional manner.

However, since it may be more economical to prepare the mixtures of polyalkylamines of formula (IV), the mixtures of polyalkylamine of formula (IV) are preferred. If appropriate, mixtures of polyalkylamines of formulas (III) and/or (IV) are used.

The branched polyalkylamines of the invention can be produced with any synthesis method known to skilled persons. One conventional method uses a diamine and involves two or more cycles, preferably two for reasons of economy, each cycle comprising a cyanoethylation step and hydrogenation step. In the remainder hereof, this method is called a two-step method. In an alternative method, one equivalent of di-alkyl diamine can be reacted in a single step with two or more equivalents of acrylonitrile, followed by hydrogenation. In this case, optional additional cycles involving cyanoethylation and hydrogenation steps can be envisaged. Said one-step method can be advantageous since it requires fewer intermediate steps. To increase branching in the two-step method, an acid catalyst is used such as HCl or acetic acid. Also, an increase in the reaction temperature during cyanoethylation also allows increased branching in this method. When conducting a multi-cycle method, the temperature of a subsequent cyanoethylation step is higher than the temperature of a preceding cyanoethylation step, allowing a compound to be obtained with the desired branching. In one embodiment, more than one mole of acrylonitrile per mole of initial polyamines used, which also allows increased branching of the expected product to the desired level. Appropriately, and to maintain a homogeneous reaction mixture, a solvent is used. Preferred solvents comprise $C_{1-4}$ alcohols and $C_{2-4}$ diols. Preferably, ethanol is used since it provides particular ease of handling. Surprisingly, it has been shown that $C_{1-4}$ alcohols and $C_{2-4}$ diols are not mere solvents but also have co-catalytic activity at the cyanoethylation step. The amount of solvent employed may vary over a wide range. For reasons of economy, the amount employed is preferably minimal. The amount of solvent, in particular at the cyanoethylation step, is preferably less than 50, 40, 30 or 25 weight % relative to the liquid reaction mixture. The amount of solvent, in particular at the cyanoethylation step is preferably higher than 0.1, 0.5, 1, 5 or 10 weight % relative to the liquid reaction mixture.

With regard to the detergents used in the lubricant compositions of the invention, these are well known to skilled persons.

In one particular embodiment of the invention, the detergents usually used in the formulation of lubricant compositions are typically anionic compounds comprising a long lipophilic hydrocarbon chain and hydrophilic head. The associated cation is typically a metal cation of an alkaline or alkaline-earth metal.

The detergents are preferably selected from among the salts of alkaline or alkaline-earth metals, of carboxylic, sulfonate, salicylate, naphthenate acids, and the salts of phenates.

The alkaline and alkaline-earth metals are preferably calcium, magnesium, sodium or barium.

These metal salts can contain the metal in approximately stoichiometric amount. In this case, the term non-overbased or «neutral» detergent is used, although they also contribute a certain amount of basicity. These «neutral» detergents typically have a BN, measured in accordance with ASTM D2896, of less than 150 mg KOH/g, or less than 100, or less than 80 mg KOH/g.

This type of so-called neutral detergent can partly contribute to the BN of the lubricants of the present invention. For example, neutral detergents of carboxylate, sulfonate, salicylate, phenate, naphthenate type can be employed of alkaline and alkaline-earth metals e.g. calcium, sodium, magnesium, barium.

If the metal is in excess (in an amount higher than the stoichiometric amount), the detergents will be so-called overbased detergents. They have a high BN, higher than 150 mg KOH/g, typically between 200 and 700 mg KOH/g, and generally between 250 and 450 mg KOH/g.

The excess metal imparting the overbased nature to the detergent is in the form of oil-insoluble metal salts e.g. carbonate, hydroxide, oxalate, acetate, glutamate, preferably carbonate.

In one same overbased detergent, the metals of these insoluble salts can be the same as those of oil-soluble detergents or they may differ therefrom. They are preferably selected from among calcium, magnesium, sodium or barium.

Overbased detergents are therefore in the form of micelles composed of insoluble metal salts held in suspension in the lubricant composition by detergents in the form of oil-soluble metal salts.

These micelles may contain one or more types of insoluble metal salts, stabilized by one or more types of detergent.

Overbased detergents comprising a single type of soluble metal salt detergent are generally named according to the type of hydrophobic chain of the latter detergent.

They are therefore said to be of carboxylate, phenate, salicylate, sulfonate, naphthenate type depending on whether this detergent is respectively a carboxylate, phenate, salicylate, sulfonate, or naphthenate.

Overbased detergents are said to be of mixed type if the micelles comprise several types of detergents differing in their type of hydrophobic chain.

For use in lubricant compositions according to the present invention, the oil-soluble metal salts are preferably carboxylates, phenates, sulfonates, salicylates, and mixed phenate-sulfonate and/or calcium, magnesium, sodium or barium salicylate detergents.

The insoluble metal salts contributing the overbased nature are carbonates of alkaline and alkaline-earth metals, preferably calcium carbonate or magnesium carbonate.

The overbased detergents used in the lubricant compositions of the present invention are preferably carboxylates, phenates, sulfonates, salicylates and mixed phenate-sulfonate-salicylate detergents, overbased with calcium carbonate or magnesium carbonate.

Preferably, the lubricant composition comprises from 4 to 30 weight % of detergent relative to the total weight of the lubricant composition, preferably 5 to 25% e.g. 6 to 25 %.

Lubricant Composition

The fatty amine or mixture of fatty amines of the invention allowing the reducing and/or controlling of abnormal gas combustion in a marine engine is contained in a lubricant composition. Said lubricant composition comprises:

- at least one base oil, preferably a lubricant base oil for marine engine;
- at least one detergent containing alkaline or alkaline-earth metals, overbased with metal carbonate salts.

Therefore, the lubricant composition of the invention comprises:

- at least one base oil, preferably a lubricant base oil for marine engine;
- at least one detergent containing alkaline or alkaline-earth metals, overbased with metal carbonate salts;
- at least one fatty amine in particular such as defined above; the amine/detergent weight ratio being between 0.01 and 1, preferably between 0.01 and 0.9, more preferably between 0.02 and 0.8 e.g. between 0.03 and 0.8.

Preferably, the lubricant composition has a BN determined in accordance with standard ASTM D-2896 of 70 milligrams or less of potassium hydroxide per gram of lubricant, preferably 60 milligrams or less.

Advantageously, the lubricant composition has a BN determined in accordance with standard ASTM D-2896 of between 5 and 70 milligrams of potassium hydroxide per gram of lubricant, preferably between 10 and 60 milligrams of potassium hydroxide per gram of lubricant.

In one embodiment of the invention, the weight percentage of fatty amine relative to the total weight of the cylinder lubricant is selected so that the BN contributed by this fatty amine represents a contribution of 1 to 20 milligrams of potassium hydroxide per gram of lubricant relative to the total BN of said cylinder lubricant.

The share of BN contributed by a fatty amine in the cylinder lubricant according to the invention (in milligrams of potassium hydroxide per gram of end lubricant, or BN «points») is calculated from its intrinsic BN measured in accordance with standard ASTM D-2896 and its weight percentage in the end lubricant:

BN amine lub=x·BN amine/100

BN amine lub=amine contribution to the BN of the end lubricant x=weight % of the amine in the end lubricant BN amine=intrinsic BN of the amine alone (ASTM D-2896).

In another embodiment of the invention, the fatty amine represents from 0.1 to 10 weight % relative to the total weight of the lubricant composition, preferably 0.1 to 6%, e.g. 0.5 to 6%.

Preferably, the lubricant composition also comprises at least one neutral detergent, in particular such as defined above.

Preferably, the lubricant composition comprises from 4 to 30 weight % of detergents relative to the total weight of the lubricant composition, preferably 5 to 25% e.g. 6 to 25%.

In one particular embodiment of the invention, the base oil contained in the lubricant composition is selected from among oils of mineral, synthetic or vegetable origin and the mixtures thereof.

The mineral or synthetic oils generally used in the application belong to one of the classes defined in the API classification such as summarised in the table below.

| | Saturates content | Sulfur content | Viscosity Index |
|---|---|---|---|
| Group 1 Mineral oils | <90% | >0.03% | 80 ≤ VI < 120 |
| Group 2 Hydrocracked oils | ≥90% | ≤0.03% | 80 ≤ VI < 120 |
| Group 3 Hydroisomerized oils | ≥90% | ≤0.03% | ≥120 |
| Group 4 | | PAO | |
| Group 5 | | Other bases not included in base groups 1 to 4 | |

The mineral oils in Group 1 can be obtained by distillation of selected naphthene or paraffin crude followed by purification of these distillates with methods such as solvent extraction, solvent or catalytic dewaxing, hydrotreatment or hydrogenation.

The oils in Groups 2 and 3 are obtained by more severe purification methods e.g. a combination from among hydrotreatment, hydrocracking, hydrogenation and catalytic dewaxing.

Examples of synthetic bases in Groups 4 and 5 include poly-alpha olefins, polybutenes, polyisobutenes, alkylbenzenes.

These base oils can be used alone or in a mixture. A mineral oil can be combined with a synthetic oil.

Cylinder oils for diesel 2-stroke marine engines have the viscosity grade SAE-40 to SAE-60, generally SAE-50 equivalent to kinematic viscosity at 100 ° C. of between 16.3 and 21.9 $mm^2/s$.

Grade 40 oils have kinematic viscosity at 100° C. of between 12.5 and 16.3 $mm^2/s$.

Grade 50 oils have kinematic viscosity at 100° C. of between 16.3 and 21.9 $mm^2/s$.

Grade 60 oils have kinematic viscosity at 100° C. of between 21.9 and 26.1 V.

According to custom in the profession, cylinder oils for diesel 2-stroke marine engines can be formulated to have kinematic viscosity at 100° C. of between 18 and 21.5, preferably between 19 and 21.5.

This viscosity can be obtained by mixing additives and base oils e.g. containing mineral bases from Group 1 such as Neutral Solvent bases (e.g. 500NS or 600 NS) and Bright-stock and/or mineral bases from Group 2. Any other combination of mineral, synthetic bases or of vegetable origin which, in a mixture with the additives, have viscosity compatible with grade SAE-50 can be used.

Typically, a conventional formulation of cylinder lubricant for slow diesel 2-stroke marine engines is grade SAE 40 to SAE 60, preferably SAE 50 (according to SAE J300 classification) and comprises at least 50 weight % of one or more lubricant base oils of mineral and/or synthetic origin, adapted for use in a marine engine e.g. API Class 1 Group 1 and/or Group 2 i.e. obtained by distillation of selected crudes followed by purification of these distillates with methods such as solvent extraction, solvent or catalytic dewaxing, hydrotreatment or hydrogenation. For the base oils of Group 1, their Viscosity Index (VI) is between 80 and 120; their sulfur content is higher than 0.03% and their saturate content lower than 90%. For base oils in Group 2, their Viscosity Index (VI) is between 80 and 120; their sulfur content is 0.03% or lower and their saturate content 90% or higher.

In one particular embodiment of the invention, the lubricant composition may also comprise one or more thickening additives having the role of increasing the hot and cold viscosity of the composition, or additives improving the viscosity index (VI).

Preferably, these additives are most often low molecular weight polymers, of approximately 2000 to 50 000 dalton (Mn).

They can be selected from among PIBs (in the region of 2000 dalton), Polyacrylates or Polymethacrylates (in the region of 30000 dalton), Olefin-copolymers, Copolymers of olefins and alpha-olefins, EPDM, Polybutenes, high molecular weight Poly-Alpha-Olefins (viscosity 100° C.>150), Styrene-Olefin copolymers, hydrogenated or non-hydrogenated.

In one particular embodiment of the invention, the base oil(s) contained in the lubricant composition of the invention can be partly or fully substituted by these additives.

In this case, the polymers used to substitute one or more base oils in full or in part are preferably the aforementioned thickeners of PIB type (e.g. marketed under the trade name Indopol H2100).

In one particular embodiment of the invention, the lubricant composition may also comprise an anti-wear additive.

Preferably, the anti-wear additive is zinc dithiophosphate or DTPZn. In this category various phosphorus-, sulfur-, nitrogen-, chlorine- and boron-containing compounds are also found.

There is a wide variety of anti-wear additives, but the category the most used is that of phospho-sulfur additives such as metal alkylthiophosphates, in particular zinc alkylthiophosphates, and more specifically zinc dialkyl dithiophosphates or DTPZn.

Amine phosphates, polysulfides in particular sulfur-containing olefins are also routinely employed anti-wear additives.

In lubricant compositions anti-wear and extreme pressure additives are also usually found of nitrogen- and sulfur-containing type, such as metal dithiocarbamates, in particular molybdenum dithiocarbamate. Glycerol esters are also anti-wear additives. Mention can be made for example of mono-, di- and trioleates, monopalmitates and monomyristates.

In one particular embodiment of the invention, the lubricant composition may also comprise at least one dispersant.

Dispersants are well known to be used as additives in the formulation of lubricant compositions, in particular for application to the marine sector. Their primary role is to maintain in suspension the particles initially present or occurring in the lubricant composition when in use in an engine. They prevent the agglomeration thereof by acting on steric hindrance. They can also have a synergic effect on neutralisation.

The dispersants used as lubricant additives typically contain a polar group, associated with a relatively long hydrocarbon chain generally containing 50 to 400 carbon atoms. The polar group typically contains at least one nitrogen, oxygen or phosphorus element.

The compounds derived from succinic acid are dispersants given much use as lubricant additives. Particular use is made of succinimides obtained via condensation of succinic anhydrides and amines, of succinic esters obtained by condensation of succinic anhydrides and alcohols or polyols.

These compounds can then be treated by various compounds in particular sulfur, oxygen, formaldehyde, carboxylic acids and compounds containing boron or zinc, to produce borate-containing succinimides for example or zinc-blocked succinimides.

Mannich bases, obtained by polycondensation of phenols substituted by alkyl groups, formaldehyde and primary or secondary amines are also compounds used as dispersants in lubricants.

A dispersant from the family of succinimide PIBs can be used e.g. borate-containing or zinc-blocked.

In one particular embodiment of the invention, the lubricant composition may also any type of functional additives adapted for use thereof, e.g. antifoam additives to counter the effect of the detergents, these possibly being polar polymers such as polymethylsiloxanes, polyacrylates, antioxidant and/or anti-corrosion additives e.g. organometallic detergents or thiadiazoles. These are known to persons skilled in the art.

In the present invention, the described lubricant compositions refer to compounds taken separately before mixing, on the understanding that said compounds may or may not maintain the same chemical form before and after mixing. Preferably, the lubricants of the invention obtained by mixing compounds taken separately are not in the form of an emulsion or microemulsion.

Marine Engine

The use of one of more fatty amines of the invention soluble in a lubricant composition, in a specific weight ratio relative to the detergent of the lubricant composition, allows the reducing and/or controlling of abnormal gas combustion in a marine engine.

In one particular embodiment of the invention, the marine engine is a pure gas engine or dual fuel engine, two-stroke or four-stroke.

In one particular embodiment of the invention, the use of one or more fatty amines of the invention, in a specific weight ratio relative to the detergent of the lubricant composition, allows the reducing and/or controlling of abnormal gas combustion in a marine engine caused by autoignition of the lubricant composition.

In one particular embodiment of the invention, the use of one of more fatty amines soluble in a lubricant composition, in a specific weight ratio relative to the detergent of the lubricant composition, allows the reducing and/or controlling of abnormal combustion of any type of gas, in particular gas having a low methane number (MN), preferably a methane number lower than 80, more advantageously lower than 60.

In general, it is known that the lower the methane number (MN) of a gas the more the phenomenon of abnormal gas combustion is increased.

The different embodiments, variants, preferences and advantages described above can be taken separately or in combination to implement the first subject of the invention.

Process

A second subject of the invention covers a process for reducing and/or controlling abnormal gas combustion in a marine engine, wherein the gas is in contact with one or more fatty amines soluble in a lubricant composition comprising at least one detergent, the amine/detergent weight ratio being between 0.01 and 1, preferably between 0.01 and 0.9, more preferably between 0.02 and 0.8, for example between 0.03 and 0.8.

The fatty amine, the detergent and the lubricant composition are such as defined above.

The different embodiments, preference, advantages, variants described for the first subject of the invention covering the use of one or more fatty amines soluble in a lubricant composition for reducing and/or controlling abnormal gas combustion in a marine engine, apply separately or in combination to the second subject of the invention covering the above-described process.

The present invention also concerns the use of the lubricant composition of the invention for reducing and/or controlling abnormal gas combustion in a marine engine, preferably a pure gas or dual fuel engine, two-stroke or four-stroke.

The present invention also concerns the use of the lubricant composition of the invention to reduce and/or control abnormal gas combustion in a marine engine caused by autoignition of the lubricant composition.

The use of the invention concerns any type of gas, in particular gas having a low methane number (MN), preferably a methane number lower than 80, more advantageously lower than 60.

The present invention also concerns a process for reducing and/or controlling abnormal gas combustion in a marine engine, comprising lubrication of the engine with a lubricant composition of the invention. Preferably, the marine engine is of pure gas type or dual fuel type, two-stroke or four-stroke.

The present invention also concerns a process for reducing and/or controlling abnormal gas combustion in a marine engine caused by autoignition of a lubricant composition, which comprises engine lubrication with a lubricant composition of the invention.

The processes of the invention concern any type of gas, in particular gas having a low methane number (MN), preferably a methane number lower than 80, advantageously lower than 60.

The invention is illustrated by the following examples that are nonlimiting. The test conducted to measure the frequency of pre-ignition of the gas mixture in contact with a lubricant composition was carried out in a single-cylinder gas engine comprising a combustion chamber with a bore of 108 mm and stroke of 115 mm with a compression rate of 11.4, corresponding to a single-cylinder capacity of 1054 $cm^3$. The rotation speed of the single-cylinder gas engine was 1000 rpm. The operating point chosen was equal to an Indicated Mean Effective Pressure of 23 bar, corresponding to an application representing a heavy engine load.

The single-cylinder gas engine had a spark plug ignition system using «open chamber» technology for precise repetition of the ignition command at each engine combustion cycle. The single-cylinder gas engine was also provided with a cylinder pressure sensor to measure changes in pressure in the cylinder, determine the values of maximum cylinder pressure at each engine cycle, and to calculate the energy released during the combustion cycle.

Prior to the test to measure abnormal gas combustion in the combustion chamber, a mixture was prepared formed of gas having a methane number equivalent to 70% and air comprising nitrogen and oxygen in an excess air ratio (air/gas) of 1.6 relative to the stoichiometric ratio used for gas combustion.

To make visible the effect of the lubricant on the phenomenon of abnormal combustion, the air-gas mixture was heated to a temperature of about 55° C. then gradually increased, in particular up to a maximum temperature of 110° C., and compressed at 3.6 bar on admission to the single-cylinder gas engine.

FIG. 1 translates percentage pre-ignition by the lubricant as a function of the admission temperature.

Figure 2:
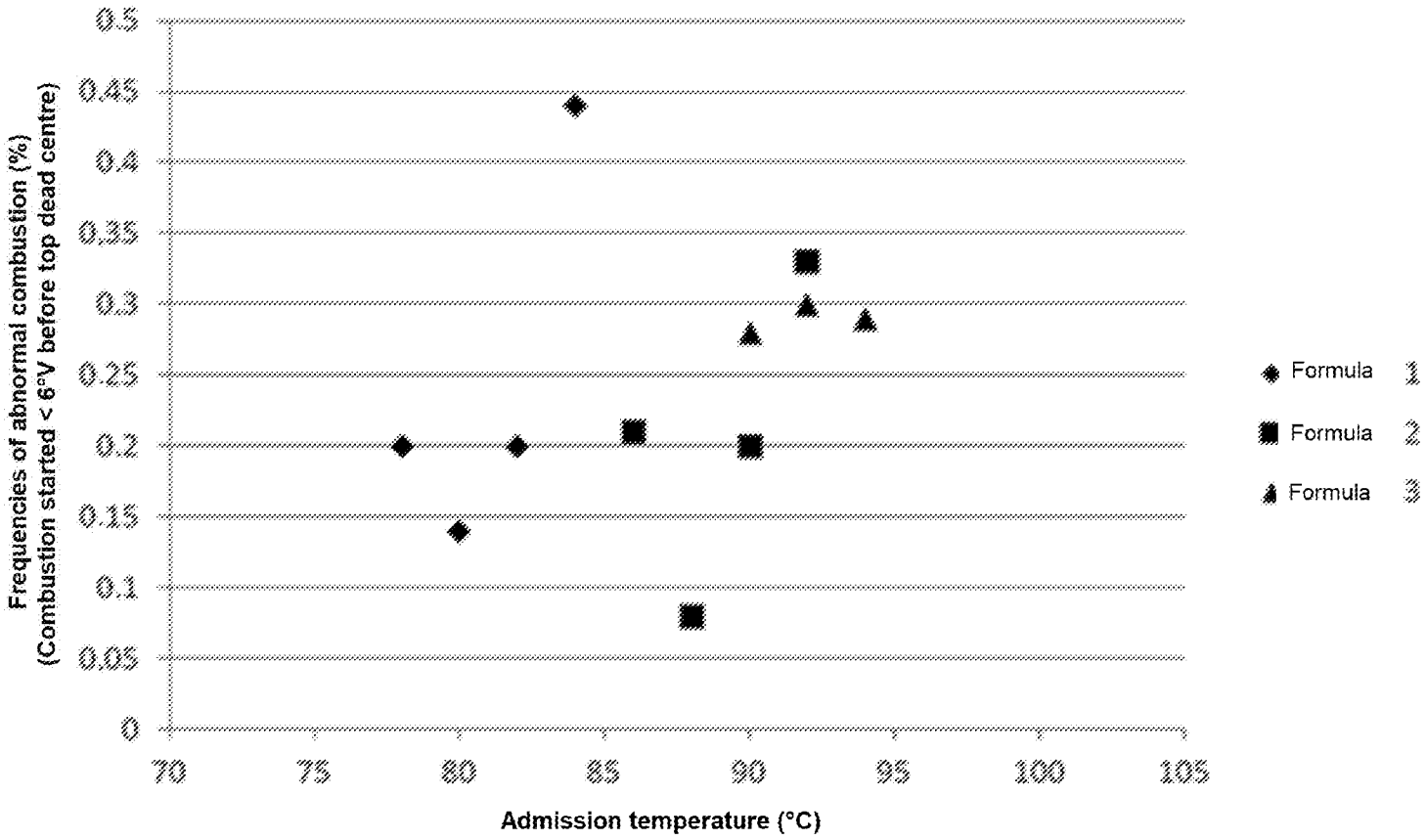

FIG. 2 translates the frequency of abnormal combustion as a function of admission temperature.

Figure 3:
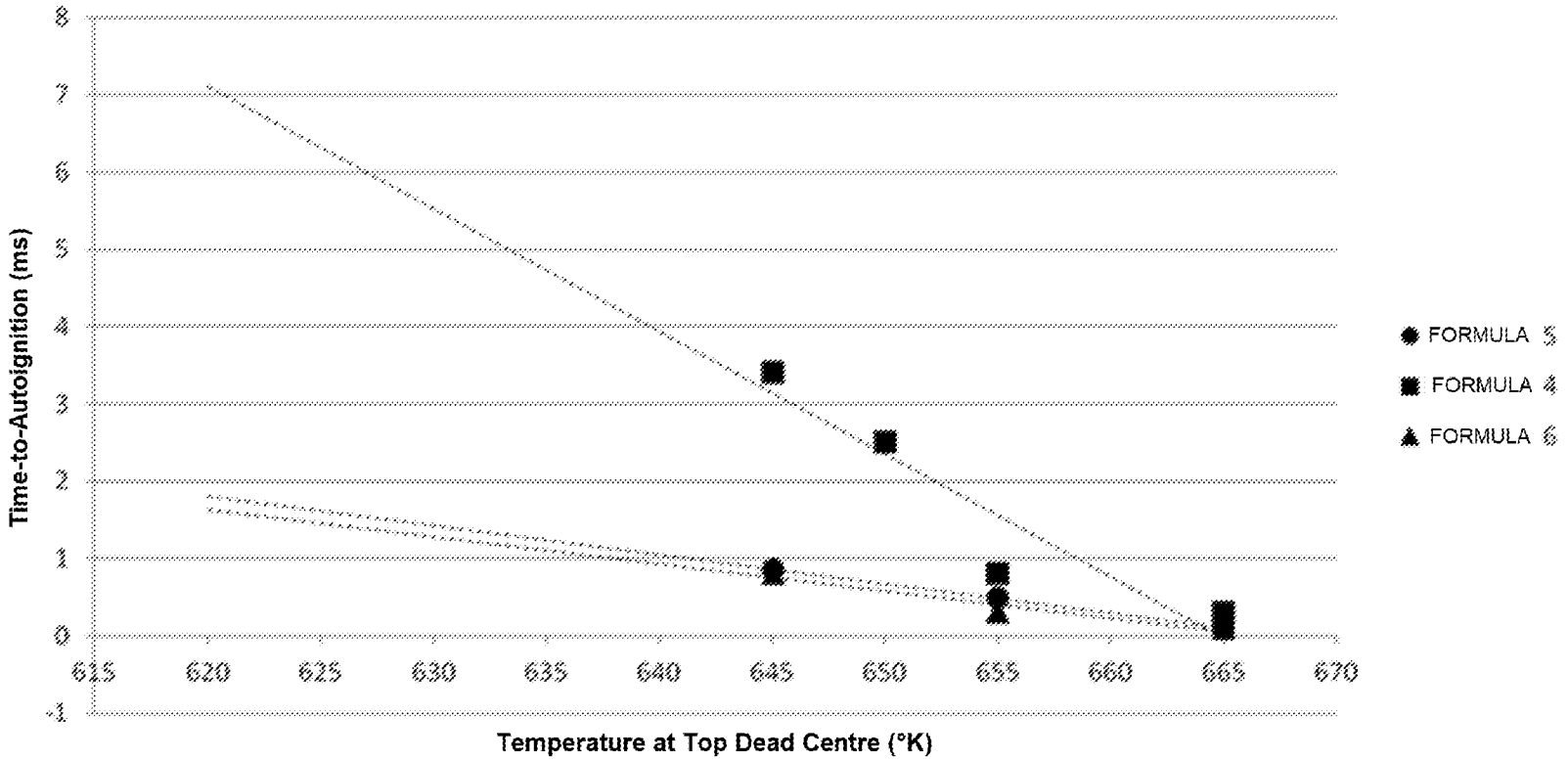

FIG. 3 translates the time to autoignition as a function of temperature at the top dead centre.

EXAMPLE 1

Experimental Protocol for Measuring the Frequency of Initiated Pre-Ignition by the Lubricant Before the Ignition Command of the Single-Cylinder Gas Engine, and the Frequency of Abnormal Combustion Generated by Pre-Ignition of the Lubricant To determine the effect of the lubricant on the phenomenon of abnormal combustion, the frequency of initiated pre-ignition was measured on the single-cylinder gas engine due to the lubricant before the main ignition command of the engine, and the frequency of pre-ignition by the lubricant generating a rise in cylinder pressure corresponding to abnormal combustion.

To determine the frequency of initiated pre-ignition due to the lubricant, the law of heat release rate was measured for each combustion cycle. The ignition command was set in repeatable manner at −4° crankshaft angle before the top dead centre. Therefore, for each cycle, each rise in energy release starting before a crankshaft angle of −6° was counted as abnormal pre-ignition generated by the lubricant before the main engine ignition command. The test was started at an admission temperature of the air-gas premix at about 55° C. Throughout the test, the temperature was gradually increased until the pre-ignition event was observed. All these abnormal events in relation to all the 15 000 combustion events recorded during the 30 minutes of each test gave the frequency of abnormal pre-ignition generated by the lubricant before the main engine ignition command.

To determine the frequency of pre-ignition by the lubricant generating a rise in cylinder pressure corresponding to abnormal combustion, the maximum pressure reached in the cylinder for each cycle was measured. The test was started at an admission temperature of the air-gas premix set at about 55° C. Throughout the test, the temperature was gradually increased until the pre-ignition event was observed. The operating point of the single-cylinder gas engine was fixed and generated a normal maximum cylinder pressure of 80 bar. In the event of abnormal combustion, it was considered that the maximum cylinder pressure in the combustion chamber must exceed the limit of 120 bar so that the cycle could be counted as abnormal ignition generated by the lubricant. All these abnormal events in relation to all the 15 000 combustion events recorded during the 30 minutes of each test gave the frequency of abnormal pre-ignition generated by the lubricant.

This test inter alia allows evidencing of the effect of the lubricant on resistance to the phenomenon of pre-ignition of the air-gas mixture due to autoignition of the lubricant before the normal ignition command, and the effect of the lubricant on the intensity of the maximum cylinder pressure peaks in the event of abnormal combustion, representing the energy released by abnormal combustion.

The lubricant compositions in Table 1 were tested. The fatty amines used in these compositions are the following:

Fatty amine 1: mixture of amines (III) and (IV)

TABLE 1

| Formulation | 1 (control) | 2 | 3 |
|---|---|---|---|
| Base oil (weight %) | 88.9 | 88.4 | 81.1 |
| Detergents (weight %) | 11.1 | 9.6 | 18.4 |
| Fatty amine 1 (weight %) | — | 2.0 | 0.5 |
| Weight ratio amine/ detergent | 0 | 0.21 | 0.03 |

The results given in FIG. 1 were generated from temperature conditions in which a phenomenon of abnormal combustion was initiated, and translate the intensity of the abnormal combustion phenomenon.

The results given in FIG. 2 translate the temperature conditions on and after which the phenomenon of abnormal combustion occurred, and the frequencies of onset of this phenomenon over a given cycle.

In FIG. 2, the frequency was measured of initiated pre-ignition due to the lubricant as a function of the admission temperature of the air-gas premix. It can be seen that this frequency is reduced for the compositions of the invention i.e. the frequency of initiated pre-ignition also called abnormal combustion starts at a higher temperature contrary to the comparative composition.

In addition, it is also observed that at one same admission temperature of the air-gas premix, the frequency of initiated pre-ignition due to the lubricant is lower for the compositions of the invention contrary to the comparative composition.

In FIG. 2, the frequency was measured of pre-ignition by the lubricant generating a rise in cylinder pressure corresponding to abnormal combustion as a function of the admission temperature of the air-gas premix. It can be seen that this frequency is reduced for the compositions of the invention i.e. the frequency of pre-ignition by the lubricant generating a rise in cylinder pressure corresponding to abnormal combustion starts at a higher temperature contrary to the comparative composition.

In addition, it is also observed that at one same admission temperature of the air-gas premix, the frequency of pre-ignition by the lubricant generating a rise in cylinder pressure corresponding to abnormal combustion is lower for the compositions of the invention contrary to the comparative composition.

Therefore, following from the results in FIGS. 1 and 2, it is observed that the compositions of the invention allow both limiting of the onset of the abnormal combustion phenomenon and limiting of the intensity thereof, contrary to the comparative composition.

EXAMPLE 2

Experimental Protocol for Measuring the Time to Ignition of Abnormal Combustion Generated by Pre-Ignition of the Lubricant The objective here was to evaluate the reduction in the phenomenon of abnormal gas combustion in a marine engine when the gas is contacted with the compositions of the invention contained in a lubricant composition.

For this purpose, different lubricant compositions were prepared from the following compounds:

- a lubricant base oil comprising a mixture of Group 1 and/or II mineral oils, in particular oils of Brightstock type,
- a détergent package,
- fatty amine 1: mixture of amines (III) and (IV),
- fatty amine 2: fatty diamine (I)

Composition 4 of the invention and two reference lubricant compositions 5 and 6 are described in Table 2; the percentages given are weight percentages.

TABLE 2

| Formulations | 4 | 5 (reference) | 6 (reference) |
|---|---|---|---|
| Base oil | 83.6 | 93.2 | 94.4 |
| Detergents | 8.9 | 2.1 | 5.6 |
| Fatty amine 1 | 7.5 | 0 | 0 |
| Fatty amine 2 | 0 | 4.7 | 0 |
| Weight Ratio amine/ detergent | 0.8 | 2.2 | 0 |

The test for measuring time-to-ignition of gas combustion when the gas is in contact with a lubricant composition was conducted in a rapid compression machine (RCM) comprising a combustion chamber with bore of 80.4 mm and stroke of 95 mm respectively. The piston motion speed in the RCM corresponded to engine rotation of 600 rpm. The RCM also comprised a cylinder head device with quartz insert allowing visualisation of gas combustion in the combustion chamber by means of a rapid acquisition camera (30 000 fps).

Prior to the test to measure abnormal gas combustion in a RCM combustion chamber, a mixture was prepared formed of gas having a methane number equivalent to 70% and air containing nitrogen and oxygen in an excess air ratio (air-gas) of 1.5 relative to the stoichiometric ratio used for gas combustion.

Under a pressure of 19 MPa using a piezoelectric-controlled injector, 0.1 mg of lubricant composition was injected into the RCM. The air-gas mixture was previously heated to a temperature of between 60 and 80° C. and injected under pressure varying between 100 kPa and 270 kPa into the cylinder and compressed at a compression rate ε varying between 7.4 and 11.5.

This test inter alia allows evidencing of the effect of the lubricant on autoignition of the air-gas mixture.

Following the above protocol, the released pressure and released energy were measured during gas combustion when in contact with compositions 4, 5 and 6 respectively. The time-to-ignition of abnormal combustion was also measured in FIG. 3.

It can be seen in FIG. 3 that the time to pre-ignition after autoignition of the lubricant composition of the invention (lubricant composition 4) is longer than the time to pre-ignition after autoignition of the reference lubricant compositions (lubricant compositions 5 and 6).

Since the time to pre-ignition through autoignition of lubricant composition 4 is optimised compared with the reference lubricant compositions 5 and 6, it is therefore observed that the phenomenon of abnormal combustion is decreased in the presence of lubricant composition 4 containing one or more fatty amines of the invention, compared with the reference lubricant compositions 5 and 6.

It follows that the lubricant composition of the invention is shown to reduce and/or control abnormal gas combustion in a marine engine.

The invention claimed is:

1. A method for reducing and/or controlling abnormal gas combustion in a marine engine, comprising using one or more fatty amines soluble in a lubricant composition comprising at least one detergent to reduce and/or control abnormal gas combustion in a marine engine, wherein said lubricant composition has a amine/detergent weight ratio of between 0.01 and 1, and wherein the fatty amine is selected from a mixture of fatty polyalkylamines comprising one or more polyalkylamines of formulas (III) and/or (IV):

(III)

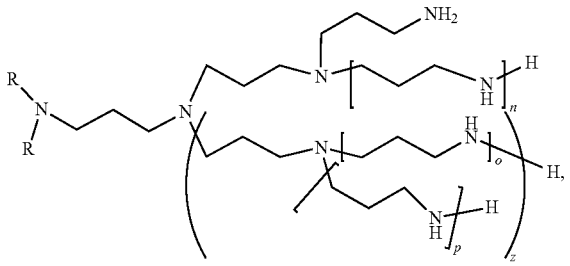

(IV)

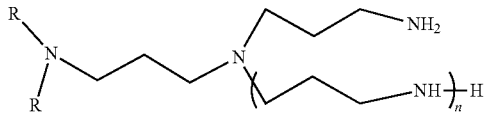

where:

R, the same or different, is a linear or branched alkyl group having 8 to 22 carbon atoms;

n and z are each independently 0, 1, 2 or 3; and when z is higher than 0, o and p are each independently 0, 1, 2 or 3, said mixture comprising at least 3 weight % of branched compounds such that at least one of n or z is 1 or higher, or the derivatives thereof.

2. The method according to claim 1, wherein the fatty amine represents from 0.1 to 10 weight % relative to the total weight of the lubricant composition.

3. The method according to claim 1, wherein the composition comprises at least one dispersant.

4. The method according to claim 1, wherein said method is used to reduce and/or control abnormal gas combustion in a marine pure gas or dual fuel engine, two-stroke or four-stroke.

5. The method according to claim 1, wherein said method is used to reduce and/or control abnormal gas combustion in a marine engine caused by autoignition of the lubricant composition.

6. The method according to claim 1 wherein said method is used with any type of gas.

7. A method for reducing and/or controlling abnormal gas combustion in a marine engine, comprising lubrication of the engine with a lubricant composition comprising:

at least one base oil;

at least one fatty amine;

at least one detergent, the amine/detergent weight ratio being between 0.01 and 1;

wherein the fatty amine is selected from a mixture of fatty polyalkylamines comprising one or more polyalkylamines of formulas (III) and/or (IV):

(III)

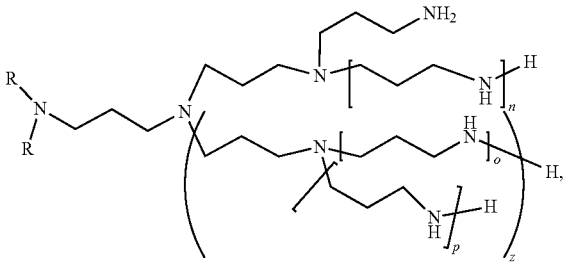

-continued (IV)

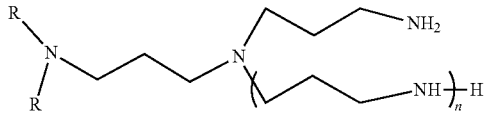

where:

R, the same or different, is a linear or branched alkyl group having 8 to 22 carbon atoms;

n and z are each independently 0, 1, 2 or 3; and when z is higher than 0, o and p are each independently 0, 1, 2 or 3, said mixture comprising at least 3 weight % of branched compounds such that at least one of n or z is 1 or higher, or the derivatives thereof.

8. The method according to claim 7, wherein the fatty amine represents from 0.1 to 10 weight % relative to the weight of the lubricant composition.

9. The method according to claim 7, wherein the detergent represents from 4 to 30 weight % relative to the weight of the lubricant composition.

10. The method according to claim 7, further comprising a dispersant.

11. The method according to claim 7, wherein said method is used for reducing and/or controlling abnormal combustion of gas in a pure gas or dual fuel marine engine, two stroke or four stroke.

12. The method according to claim 7, wherein said method is used to reduce and/or control abnormal gas combustion in a marine engine caused by autoignition of the lubricant composition.

* * * * *